US007841833B2

(12) United States Patent
Suzuki et al.

(10) Patent No.: US 7,841,833 B2
(45) Date of Patent: Nov. 30, 2010

(54) TURBINE ROTOR AND TURBINE BLADE

(75) Inventors: Fumiyuki Suzuki, Hitachi (JP); Kunio Asai, Hitachi (JP); Takeshi Kudo, Hitachi (JP); Tateki Nakamura, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 909 days.

(21) Appl. No.: 11/695,786

(22) Filed: Apr. 3, 2007

(65) Prior Publication Data

US 2007/0237644 A1 Oct. 11, 2007

(30) Foreign Application Priority Data

Apr. 6, 2006 (JP) ..... 2006-104816

(51) Int. Cl.
*F01D 5/30* (2006.01)

(52) U.S. Cl. ..... 416/219 R; 416/248

(58) Field of Classification Search ..... 416/219 R, 416/248

See application file for complete search history.

(56) References Cited

U.S. PATENT DOCUMENTS 5,152,669 A * 10/1992 Heinig et al. ..... 416/219 R

FOREIGN PATENT DOCUMENTS

| | | |
|---|---|---|
| JP | 4-231602 | 8/1992 |
| JP | 5-086805 | 4/1993 |
| JP | 7-72485 | 8/1995 |
| JP | 2877150 | 1/1999 |

* cited by examiner

*Primary Examiner*—Richard Edgar
(74) *Attorney, Agent, or Firm*—Mattingly & Malur, P.C.

(57) ABSTRACT

A turbine rotor improved in machinability, appropriately balanced in stress, and having rotor hooks and rotor necks constructed to form an attachment structure with respect to an inverted fir tree blade root that has blade hooks and blade necks. The turbine rotor has rotor hooks and rotor necks constructed to form an attachment structure with respect to an inverted fir tree blade root that has blade hooks and blade necks with an "n" number of hooks, where n≧3. In this structure, a convex portion of the innermost circumferential rotor hook is formed to be concave in a circumferential direction, with respect to a tangential line that connects a convex portion of the (n−1)th hook from the outermost circumferential rotor hook, and a convex portion of the (n−2)th hook.

14 Claims, 7 Drawing Sheets

$$\frac{Lrn}{Lr(n-1)} = 0.7$$

$Rrn = Rr(n-1)$ $Drn = Dr(n-1)$ $$\frac{Lrn}{Lr(n-1)} = 1.0$$

$Rrn = Rr(n-1)$ $Drn < Dr(n-1)$ $$\frac{Lrn}{Lr(n-1)} = 0.65$$

$Rrn = Rr(n-1)$ $Drn = Dr(n-1)$ $$\frac{Lrn}{Lr(n-1)} = 1.3$$

$Rrn > Rr(n-1)$ $Drn < Dr(n-1)$

TURBINE ROTOR AND TURBINE BLADE

BACKGROUND OF THE INVENTION

1. Field of the Invention

The present invention relates to a turbine rotor and a turbine blade having an inverted fir tree blade root for insertion in an axial direction of the rotor.

2. Description of the Related Art

The adoption of longer blades in the low-pressure last stage of a steam turbine is increasing to ensure higher capacities and efficiency of the steam turbine. Accordingly, blade grooves tend to be dimensionally extended so that the stresses applied to the blade grooves will be reduced with respect to increased centrifugal stress due to the adoption of longer blades.

However, since the dimensional extension of the blade grooves correspondingly increases the radial depth of rotor grooves, the rotor becomes difficult to machine and as a result, machining jigs for cutting the rotor grooves are required to be highly rigid.

In particular, if the circumferential width of the innermost circumferential rotor hook is not large enough, it is necessary to use a grooving cutter whose lowest section is flaccid and flexible.

These conditions are likely to break the grooving cutter during rotor cutting, and thus to make the rotor non-usable, and the flexure of the grooving cutter is likely to result in the contact section of the rotor hook being cut too much and render the rotor hook unable to bear a required load. Accordingly, reliability is likely to be adversely affected.

For a turbine rotor having an inverted fir tree blade root, therefore, there is a need to prevent a grooving cutter from being broken during rotor cutting, by increasing the circumferential width of the innermost circumferential rotor hook.

A technique for preventing a grooving cutter from being broken is described in JP-B-07-72485, for example. Patent Document 1 discloses a structure in which: a hook on the innermost surface of a rotor is formed with a large circumferential hook width with respect to the circumferential width of a neck formed on the innermost surface of a blade, and a space is formed between the innermost opposed surfaces of the blade neck and the rotor hook.

In addition to the above, known analogous techniques are described in Japanese Patent Publication No. 2877150 and JP-A-05-86805.

SUMMARY OF THE INVENTION

However, there has been the problem that if a wide space is formed between the innermost opposed surfaces of the blade neck and the rotor hook, a hook contact surface distance at which the blade and the rotor come into contact is reduced and the contact surface pressure of the innermost circumferential rotor hook is correspondingly increased.

Therefore, for a steam turbine constructed to have an inverted fir tree blade root, the present invention provides a turbine rotor and turbine rotating blade capable of preventing damage to a grooving cutter during rotor-cutting operations and reducing a contact surface pressure of the innermost circumferential rotor hook, even when the circumferential width of the innermost circumferential rotor hook is increased.

The turbine rotor of the present invention includes a rotor hook and rotor neck section constructed to form an attachment structure with respect to an inverted fir tree blade root that has a blade hook and blade neck arrangement with an "n" number of hooks, where $n \geqq 3$. In this structure, a convex portion of the innermost circumferential rotor hook is formed to be concave in a circumferential direction, with respect to a tangential line which connects a convex portion of the (n−1)th hook from the outermost circumferential rotor hook, and a convex portion of the (n−2)th hook.

The above structure preferably satisfies a relationship of $Wr_n > Wr_{n-1} - 2Hr_n \times \tan \bullet r$, where •r is an angle formed between a tangential line connecting the convex portion of the (n−1)th hook from the outermost circumferential rotor hook and the convex portion of the (n−2)th hook, and a radial center line, $Hr_n$ is a radial distance between a convex portion of the nth hook from the outermost circumferential rotor hook, and the convex portion of the (n−1)th hook, $Wr_n$ is circumferential width of the innermost circumferential rotor hook, and $Wr_{n-1}$ is circumferential width of the (n−1)th hook from the outermost circumferential rotor hook.

Also, the relationship of $Dr_n < Dr_i$ is preferably satisfied, where $Dr_n$ is a distance between a normal to a hook contact surface of the nth hook from the outermost circumferential rotor hook and a normal to a hook contact surface of the (n−1)th hook, and $Dr_i$ is a distance between a normal to a hook contact surface of the ith hook (i=2 to (n−1)) from the outermost circumferential rotor hook and a normal to a hook contact surface of the (i−1)th hook.

In addition, it is preferable that a concave portion of the rotor innermost circumferential neck is formed to be concave in a circumferential direction, with respect to a tangential line which connects a concave portion of the (n−1)th neck from the rotor outermost circumferential neck, and a concave portion of the (n−2)th neck.

Furthermore, a hook contact surface on which a rotating blade and the rotor come into contact at the innermost circumferential rotor hook, and a hook contact surface on which the rotating blade and the rotor come into contact at the ith hook, that is, the 2nd to (n−1)th hook, from the outermost circumferential rotor hook, are preferably formed so as to satisfy a relationship of $Lr_n > Lr_i$, where $Lr_n$ is a distance associated with the former hook contact surface and $Lr_i$ is a distance associated with the latter hook contact surface.

Besides, a contact surface on which the blade and the rotor come into contact at a hook of the rotor, and a non-contact surface formed at an outer circumferential position with respect to the contact surface are preferably constructed to be interconnected by a flat surface and inscribed circle surfaces formed at both ends of the flat surface.

Moreover, an insertion angle for attaching the blade is preferably oblique with respect to an axial direction of the rotor.

The inverted fir tree turbine rotating blade of the present invention includes a blade hook and a blade neck constructed to form an attachment structure with respect to the turbine rotor having a rotor hook and rotor neck arrangement with an "n" number of hooks, where $n \geqq 3$. In this structure, a concave portion of the innermost circumferential blade neck is formed to be convex in a circumferential direction, with respect to a tangential line which connects a concave portion of the (n−1) th neck from the blade outermost circumferential neck, and a concave portion of the (n−2)th neck.

Preferably, the above structure satisfies a relationship of $Wb_n > Wb_{n-1} - 2Hb_n \times \tan \bullet b$, where •b is an angle formed between a tangential line connecting the concave portion of the (n−1)th neck from the blade outermost circumferential neck and the concave portion of the (n−2)th neck, and a radial center line, $Hb_n$ is a radial distance between a concave portion of the nth neck from the blade outermost circumferential neck and the concave portion of the (n−1)th neck, $Wb_n$ is circumferential width of the innermost circumferential blade neck, and $Wb_{n-1}$ is circumferential width of the (n−1)th neck from the blade outermost circumferential neck.

Also, the relationship of $Db_n<Db_i$ is preferably satisfied, where $Db_n$ is a distance between a normal to a hook contact surface of the nth hook from the outermost circumferential blade hook and a normal to a hook contact surface of the (n−1)th hook, and $Db_i$ is a distance between a normal to a hook contact surface of the ith hook (i=2 to (n−1)) from the outermost circumferential blade hook and a normal to a hook contact surface of the (i−1)th hook.

In addition, it is preferable that a convex portion of the innermost circumferential blade hook is formed to be convex in a circumferential direction, with respect to a tangential line which connects a convex portion of the (n−1)th hook from the outermost circumferential blade hook, and a convex portion of the (n−2)th hook.

Furthermore, the relationship of $Lb_n>Lb_i$ is preferably satisfied, where $Lb_n$ is a distance of a hook contact surface on which the rotating blade and the rotor come into contact at the innermost circumferential blade hook, and $Lb_i$ is a distance of a hook contact surface distance at which the rotating blade and the rotor come into contact at the ith hook (i=2 to (n−1)) from the outermost circumferential blade hook.

Besides, a contact surface on which the blade and the rotor come into contact at a hook of the blade, and a non-contact surface formed at an inner circumferential position with respect to the contact surface are preferably constructed to be interconnected by respective flat surfaces and an inscribed circle surface extending from an end of one of the two flat surfaces to an associated end of the other flat surface.

Moreover, an insertion angle of the blade root for attaching to the blade is preferably oblique with respect to the axial direction of the rotor.

In a steam turbine constructed to have an inverted fir tree blade root, the present invention makes it possible to provide a turbine rotor and turbine blade capable of preventing a grooving cutter from being broken during rotor-cutting operations and reducing the contact surface pressure of the innermost circumferential rotor hook, even when the circumferential width of the innermost circumferential rotor hook is increased.

DESCRIPTION OF THE PREFERRED EMBODIMENT

Hereunder, embodiments of the present invention will be described.

First Embodiment

A relationship between a turbine rotating blade 1 and turbine rotor 3 in a first embodiment is described below using FIGS. 1A, 1B, and 1C.

Figure 1A:
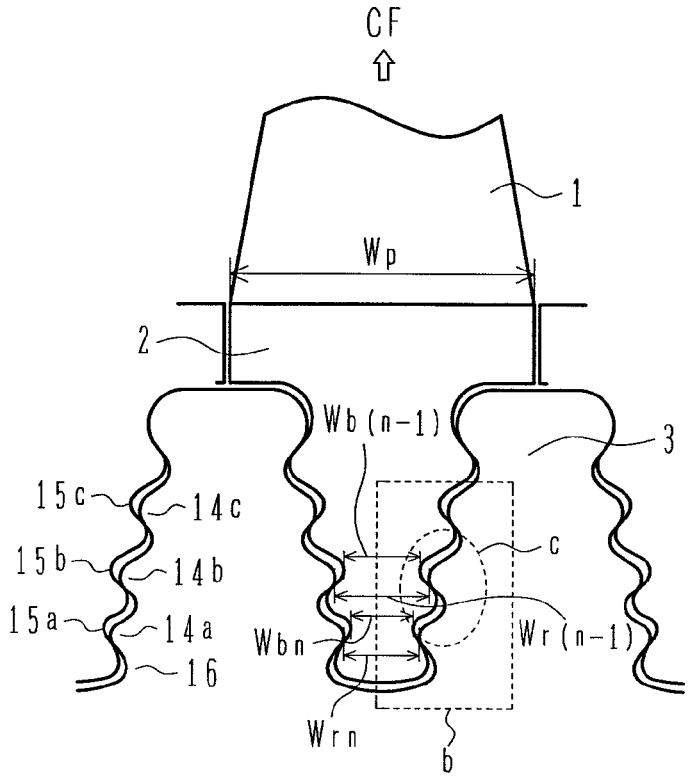
FIGS. 1A to 1C show a relationship between a turbine rotor and turbine blade of an embodiment.
Figure 1B:
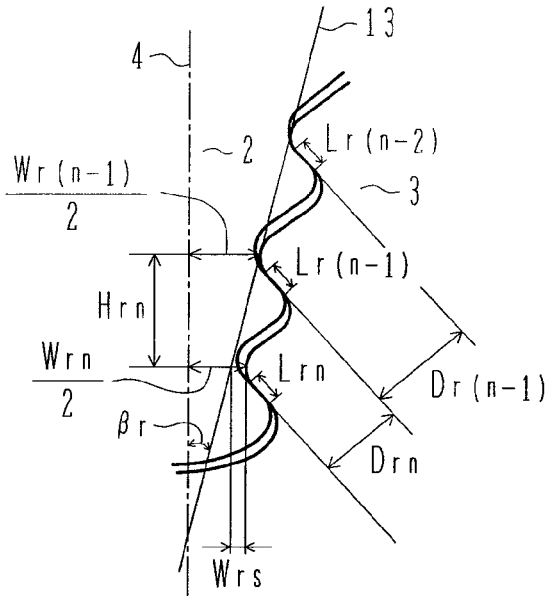
Figure 1C:
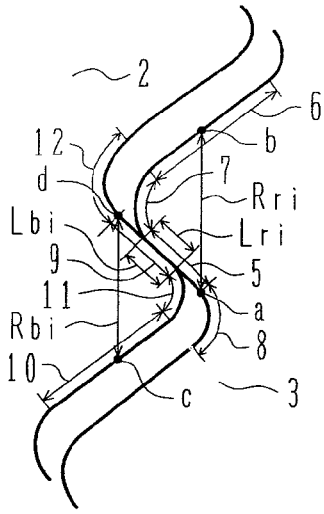

FIGS. 1A to 1C assume the case of n=4, where "n" denotes the number of hooks.

The turbine rotor 3 has a rotor hook section 14 and a rotor neck section 16, both constructed to form an attachment structure with respect to an inverted fir tree blade root 2 that has blade hooks and blade necks.

The rotating blade 1 of the turbine is of an inverted fir tree type extending in a central direction of the rotor, and has the blade hooks and blade necks that form the attachment structure with respect to the turbine rotor 3 having the rotor hook section 14 and the rotor neck section 16.

The reference symbol CF shown in FIG. 1A signifies centrifugal force applied to the blade 1, and an associated arrow denotes a direction of the centrifugal force.

Also, $Wr_n$ in FIG. 1A denotes circumferential width of the innermost circumferential rotor hook, $Wr_{n-1}$ denotes circumferential width of the (n−1)th hook (in the present embodiment, the third hook) from the outermost circumferential rotor hook, Wbn denotes circumferential width of the blade innermost circumferential neck, Wbn−1 denotes circumferential width of the (n−1)th neck (in the present embodiment, the third neck) from the blade outermost circumferential neck.

An enlarged view of a region marked with dotted line "b" in FIG. 1A is shown in FIG. 1B, and an enlarged view of a region marked with dotted line "c" in FIG. 1A is shown in FIG. 1C.

The turbine rotor 3 described in the present embodiment is constructed so that a convex portion of the innermost circumferential rotor hook is formed to be concave in a circumferential direction, with respect to a tangential line which connects a convex portion of the third hook from the outermost circumferential rotor hook, and a convex portion of the second hook.

The rotating blade 1 of the turbine, described in the present embodiment, is constructed so that a concave portion of the blade innermost circumferential neck is formed to be convex in a circumferential direction, with respect to a tangential line which connects a concave portion of the third neck from the blade outermost circumferential neck, and a concave portion of the second neck.

The inverted fir tree blade root 2 has a plurality of hooks at both the grooved side of the blade and that of the rotor, and is constructed so that the hook section of the blade and that of the rotor are engaged with each other by inserting the groove of the blade in an axial direction of the blade to support the centrifugal force of the blade.

The blade and the rotor are constructed to be symmetrical with respect to a radial center line 4.

The above structure satisfies a relationship of $Wr_n>Wr_{n-1}-2Hr_n\times\tan \bullet r$, where •r is an angle formed between the radial center line 4 and a tangential line 13 connecting the convex portion of the (n−1)th hook (in the present embodiment, the third hook) from the outermost circumferential rotor hook and the convex portion of the (n−2)th hook (in the present embodiment, the second hook), $Hr_n$ is a radial distance between a convex portion of the nth hook (in the present embodiment, the fourth hook) from the outermost circumferential rotor hook, and the convex portion of the (n−1)th hook (in the present embodiment, the third hook), $Wr_n$ is circumferential width of the innermost circumferential rotor hook, and $Wr_{n-1}$ is circumferential width of the (n−1)th hook (in the present embodiment, the third hook) from the outermost circumferential rotor hook.

Because of the symmetric structure mentioned above, half values of $Wr_n$ and $Wr_{n-1}$ are shown in FIG. 1B.

Also, the above structure satisfies a relationship of Wbn>Wbn−1−2Hbn×tan •b, where •b is an angle formed between the radial center line 4 and a tangential line connecting the concave portion of the (n−1)th neck (in the present embodiment, the third neck) from the blade outermost circumferential neck and the concave portion of the (n−2)th neck (in the present embodiment, the second neck), $Hb_n$ is a radial distance between a concave portion of the nth neck (in the present embodiment, the fourth neck) from the blade outermost circumferential neck, and the concave portion of the (n−1)th neck (in the present embodiment, the third neck), $Wb_n$ is circumferential width of the blade innermost circumferential neck, and $Wb_{n-1}$ is circumferential width of the (n−1) th neck (in the present embodiment, the third neck) from the blade outermost circumferential neck.

In addition, the relationship of $Dr_n<Dr_i(=Dr_{n-1})$ is satisfied, where $Dr_n$ is a distance between a normal to a hook contact surface of the nth hook (in the present embodiment, the fourth hook) from the outermost circumferential rotor hook and a normal to a hook contact surface of the (n−1)th hook (in the present embodiment, the third hook), and $Dr_i$ is a distance between a normal to a hook contact surface of the ith hook (i=2 to (n−1)) (in the present embodiment, the second or third hook) from the outermost circumferential rotor hook and a normal to a hook contact surface of the (i−1)th hook (in the present embodiment, the first or second hook).

In the above relationship, $Dr_{n-1}$ is a distance normal to the hook contact surface between the (n−1)th hook from the outermost circumferential rotor hook, and the (n−2)th hook.

Furthermore, the relationship of $Db_n<Db_i(=Db_{n-1})$ is satisfied, where $Db_n$ is a distance between a normal to a hook contact surface of the nth hook (in the present embodiment, the fourth hook) from the outermost circumferential blade hook and a normal to a hook contact surface of the (n−1)th hook (in the present embodiment, the third hook), and $Db_i$ is a distance between a normal to a hook contact surface of the ith hook (i=2 to (n−1)) (in the present embodiment, the second or third hook) from the outermost circumferential blade hook and a normal to a hook contact surface of the (i−1)th hook (in the present embodiment, the first or second hook).

In the above relationship, $Db_{n-1}$ is a distance normal to the hook contact surface between the (n−1)th hook from the outermost circumferential blade hook, and the (n−2)th hook.

Furthermore, the concave portion of the rotor innermost circumferential neck is formed to be concave in a circumferential direction, with respect to a tangential line connecting a concave portion of the (n−1)th neck (in the present embodiment, the third neck) from the rotor outermost circumferential neck and a concave portion of the (n−2)th neck (in the present embodiment, the second neck).

Besides, the convex portion of the innermost circumferential blade hook is formed to be convex in a circumferential direction, with respect to a tangential line connecting the convex portion of the (n−1)th hook (in the present embodiment, the third hook) from the outermost circumferential blade hook and the convex portion of the (n−2)th hook (in the present embodiment, the second hook).

Moreover, the relationship of $Lr_n>Lr_i(=Lr_{n-1}$ or $Lr_{n-2})$ is satisfied, where $Lr_n$ is a distance of a hook contact surface on which the rotating blade and the rotor come into contact at the innermost circumferential rotor hook, and $Lr_i$ is a distance of a hook contact surface on which the rotating blade and the rotor come into contact at the ith hook (i=2 to (n−1)) (in the present embodiment, the second or third hook) from the outermost circumferential rotor hook.

$Lr_{n-1}$ is a hook contact surface distance at which the rotating blade and the rotor come into contact at the (n−1)th hook from the outermost circumferential rotor hook.

Moreover, the relationship of $Lb_n>Lb_i(=Lb_{n-1}$ or $Lb_{n-2})$ is satisfied, where $Lb_n$ is a distance of a hook contact surface on which the rotating blade and the rotor come into contact at the innermost circumferential blade hook, and $Lb_i$ is a distance of a hook contact surface on which the rotating blade and the rotor come into contact at the ith hook (i=2 to (n−1)) (in the present embodiment, the second or third hook) from the outermost circumferential blade hook.

$Lb_{n-1}$ is a hook contact surface distance at which the rotating blade and the rotor come into contact at the (n−1)th hook from the outermost circumferential blade hook.

At a hook of the turbine rotor 3, a rotor hook contact surface 5 and a rotor hook non-contact surface 6 formed at an outer circumferential position with respect to the particular hook are constructed to be interconnected by a rotor hook arc 7.

At a hook of the turbine rotating blade 1, a rotating blade hook contact surface 9 and a rotating blade hook non-contact surface 10 formed at an inner circumferential position with respect to the particular hook are constructed to be interconnected by a rotating blade hook arc 11.

An insertion angle for attaching to the rotating blade 1 of the turbine is oblique with respect to an axial direction of the turbine rotor 3, and an angle of insertion of the inverted fir tree blade root 2 into the turbine rotor 3 is oblique with respect to the axial direction of the turbine rotor 3.

In the conventional structure, the convex portions of all hooks have been formed into the shape that the convex portions come into contact with one tangential line having a required angle •r from radial center line 4. In the present embodiment, however, the circumferential width $Wr_n$ of the innermost circumferential rotor hook is made greater than in the conventional structure.

As shown in FIG. 1A, when the angle formed between the radial center line 4 and the tangential line 13 connecting the convex portion 15*b* of the (n−1)th hook 14*b* (in the figure, the third hook) from the outermost circumferential rotor hook and the convex portion 15*c* of the (n−2)th hook 14*c* (in the figure, the second hook) is defined as •r, and the radial distance between the convex portion 15*a* of the nth hook 14*a* (in the figure, the innermost circumferential hook) from the outermost circumferential rotor hook, and the convex portion 15*b* of the (n−1)th hook 14*b* (in the figure, the third hook), is defined as $Hr_n$, the circumferential width $Wr_n$ of the innermost circumferential rotor hook satisfies the relationship of $Wr_n>Wr_{n-1}-2Hr_n\times\tan$ •r with respect to the circumferential width $Wr_{n-1}$ of the (n−1)th hook (in the figure, the third hook) from the outermost circumferential rotor hook.

That is, between the convex portion 15*a* of the innermost circumferential rotor hook and the tangential line 13 connecting the hook convex portions 15*b* and 15*c*, a space of $Wr_s$ (circumferential distance between the convex portion 15*a* and the tangential line 13) is formed in a circumferential direction to increase the circumferential width $Wr_n$ of the innermost circumferential rotor hook by circumferential distance $2Wr_s$ in comparison with the conventional structure.

The symbol $Wb_s$ is a circumferential distance between a tangential line that connects the concave portions of the blade necks, and the concave portion of the blade innermost circumferential neck.

It is considered to be possible, by adopting this structure, to enhance rigidity of the lowest section of a grooving cutter, to prevent the grooving cutter from being broken during rotor cutting, to prevent an increase in manufacturing tolerance due to flexure, and to facilitate rotor cutting and improving machining accuracy.

Reference number 8 used in FIG. 1C denotes the rotor neck arc; 9, the blade hook contact surface; 10, the blade hook non-contact surface; 11, the blade hook arc; and 12, the blade neck arc.

Also, the symbol $Lr_i$ is the hook contact surface distance of the ith hook from the innermost circumferential rotor hook; $Lb_i$, the hook contact surface distance of the ith hook from the outermost circumferential blade hook; $Rr_i$, a radial length value of the ith hook from the outermost circumferential rotor hook; and $Rb_i$, a radial length value of the ith hook from the outermost circumferential blade hook.

In addition, the relationship of $Dr_n<Dr_i$ (i=2 to (n−1)) is satisfied, where $Dr_n$ is the distance between the normal to the hook contact surface of the nth hook (in FIG. 1A, the innermost circumferential hook) from the outermost circumferential rotor hook and the normal to the hook contact surface of the (n−1)th hook (in FIG. 1A, the third hook), and Dr, is the distance between the normal to the hook contact surface of the ith hook (i=2 to (n−1)) from the outermost circumferential rotor hook and the normal to the hook contact surface of the (i−1)th hook.

Figure 2A:
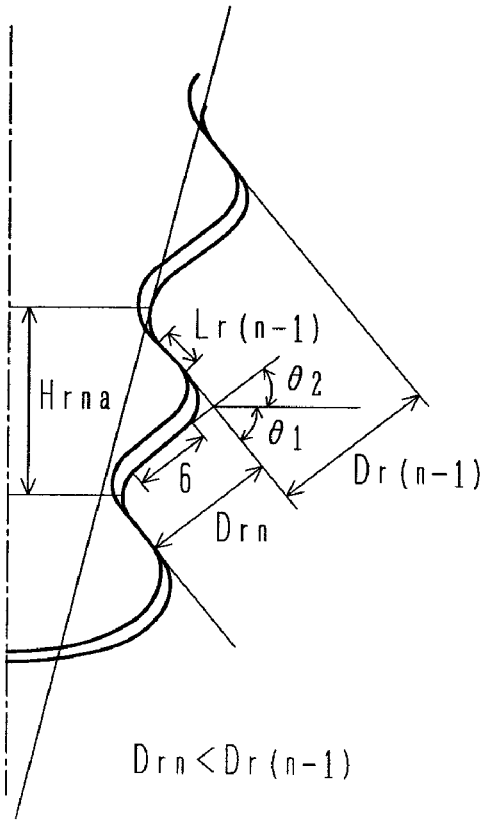
FIGS. 2A, 2B are views showing a structure of rotor hooks and blade hooks of the embodiment.
Figure 2B:
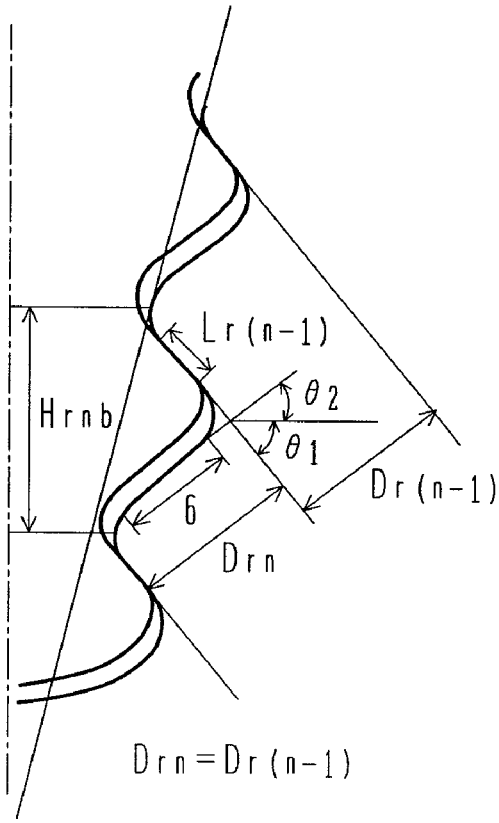

In general, the two structures shown in FIGS. 2A and 2B are usable to increase the circumferential width $Wr_n$ of the innermost circumferential rotor hook under the conditions where a contact angle •1 and a non-contact angle •2, both for forming hooks and necks, are both fixed.

The symbol •1 is the contact angle for forming a hook and a neck, and the symbol •2 is the non-contact angle for forming another hook and another neck.

Comparative study results on both structures are described hereunder.

FIG. 2A shows the structure in which the non-contact surface 6 of the innermost circumferential rotor hook is formed by reducing the distance of the non-contact surface 6 so as to satisfy the relationship of $Dr_n<Dr_i(=Dr_{n-1})$.

FIG. 2B shows the structure in which the non-contact surface of the (n−1)th hook from the outermost circumferential rotor hook is formed by increasing the distance $Lr_{n-1}$ of that non-contact surface so as to satisfy the relationship of $Dr_n<Dr_i(=Dr_{n-1})$.

When the structures in FIGS. 2A and 2B are compared in terms of the radial distance $Hr_n$ from the convex portion of the nth hook from the outermost circumferential rotor hook to the convex portion of the (n−1)th hook, $Hb_n$ in the structure in FIG. 2B is longer than $Nr_{na}$ in the structure in FIG. 2A, so the rotor groove in the structure of FIG. 2B is formed to have a larger radial depth than the rotor groove in the structure of FIG. 2A.

$Hr_{na}$ in the structure of FIG. 2A is a radial distance between the convex portion of the nth hook from the outermost circumferential rotor hook and the convex portion of the (n−1) th hook, and $Hr_{nb}$ in the structure of FIG. 2B is a radial distance between the convex portion of the nth hook from the outermost circumferential rotor hook and the convex portion of the (n−1) th hook.

As the radial depth of the rotor groove is increased, cuttability of the rotor groove will decrease since a manufacturing tolerance will be augmented by increases in flexibility of the groove cutter used to cut the rotor. In addition, as the radial depth of the rotor groove is increased, a longer cutting time will be required since the amount of cutting of the entire rotor groove will increase. These indicate, therefore, that the structure in FIG. 2A is superior.

Furthermore, as the radial depth of the rotor groove is increased, tensile stresses on the rotor innermost circumferential neck will increase since the circumferential width thereof will decrease.

Accordingly, a cuttability improvement effect and a stress reduction effect are expected to be obtainable by adopting the structure in which, as shown in FIG. 2A, the hook contact surface between the nth hook from the outermost circumferential rotor hook, and the (n−1)th hook, is formed for reduced distance $Dr_n$ normal to the contact surface, and for reduced radial depth of the rotor groove.

Another feature exists in that the relationship of $Lr_n>Lr_i$ (i=2 to n−1) is satisfied where $Lr_n$ is the hook contact surface distance of the innermost circumferential rotor hook, and $Lr_i$ is the hook contact surface distance of the ith hook (i=2 to (n−1)) from the outermost circumferential rotor hook.

If the hook contact surface of the innermost circumferential rotor hook is formed for increased distance $Lr_n$, the tangent point "a" shown in FIG. 1C moves to the inner circumferential side along the rotor hook contact surface 5, so the innermost circumferential rotor hook is formed for increased radial length $Rr_n$.

It is already seen from stress analyses that load distribution of the innermost circumferential rotor hook in a blade-rotor structure of an appropriate shape increases above an average load distribution ratio.

Therefore, increasing the radial hook length $Rr_n$ and hook contact surface distance $Lr_n$ of the innermost circumferential rotor hook larger in load distribution ratio is expected to allow appropriate distribution of stresses between hooks, since the innermost circumferential rotor hook decreases in both the shear stress and contact surface pressure occurring to the hook.

As shown in FIG. 1C, the symbol $Rr_n$ denotes the radial length of the innermost circumferential rotor hook. The tangent point at which the rotor hook contact surface 5 and the rotor neck arc 8 constituting the rotor neck 16 are inscribed by the ith (that is, 2nd or subsequent nth) rotor hook 14 from the outermost circumferential rotor hook is defined as the symbol "a".

When a crossing point of the rotor hook non-contact surface 6 and a line parallel to the radial center line 4 passing through a central portion of the inverted fir tree blade root 2, is taken as "b" with the tangent point "a" as its starting position, a distance from the tangent point "a" to the crossing point "b" can be defined as radial length $Rr_i$ of the hook.

The following describes advantageous effects of the present embodiment's structure in which compatibility between an improvement in machinability and an appropriate balancing of stresses is established using calculation results based on finite element methodological (FEM) analyses performed for "n"=4, where "n" is the number of hooks:

A blade groove enlarging parameter "•" is defined as a ratio Wb1/Wp, where Wb1 is radial circumferential width of the blade outermost circumferential neck and Wp is circumferential width of the blade bottom.

Figure 3:
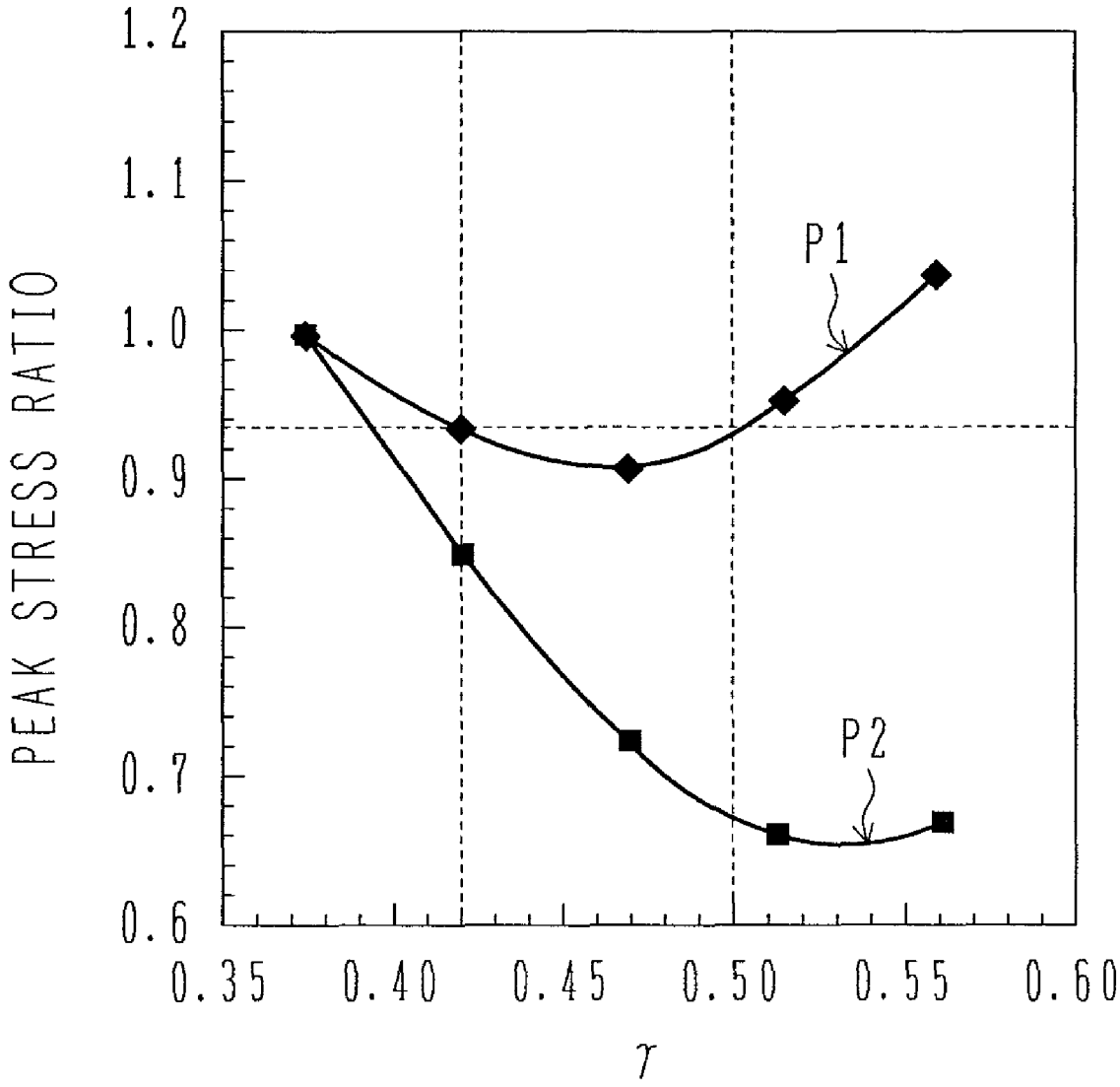
FIG. 3 is a diagram explaining a relationship between a groove magnification and a peak stress ratio.

FIG. 3 shows a relationship between the blade groove enlarging parameter "•" and a peak stress ratio based on a peak stress applied by a centrifugal force when "•" is 0.37.

As the blade groove is enlarged ("•" is increased), both the blade and the rotor tend to decrease in the peak stress ratio (for the blade, see a peak stress ratio curve P2 in FIG. 3, and for the rotor, see a peak stress ratio curve P1 in FIG. 3).

A decreasing tendency of the peak stress occurring at the blade outermost circumferential position is particularly significant. Since the blade outermost circumferential position is where relatively high stresses are applied by blade vibration, enlarging the blade groove (increasing "•") is considered to be desirable from viewpoints of both low-cycle fatigue and high-cycle fatigue.

If "•" is increased too much, however, this causes the problem that since a rotor groove with large enough a circumferential cross-sectional area cannot be obtained, tensile stresses on the rotor neck 16 and the peak stress ratio (see P1, FIG. 3) of the turbine rotor become excessive.

In general, blade materials are higher than rotor materials in terms of tensile strength. To ensure that •≦0.50, therefore, it is desirable that the circumferential width Wb1 of the blade outermost circumferential neck should be reduced below that of the rotor innermost circumferential neck, with respect to one blade of circumferential width Wp.

In FIG. 3, a region in which the peak stress ratio of the turbine rotor is reduced below a peak stress ratio achievable at •=0.50 is equivalent to a region of 0.42≦•≦0.50. The blade and the rotor are desirably designed for 0.42≦•≦0.50 as the region where the ratio of the circumferential neck widths of the blade and the rotor and the peak stress ratio of the turbine rotor are well balanced.

P1 is a peak stress ratio curve based on the centrifugal force of the turbine rotor, and P2 is a peak stress ratio curve based on the centrifugal force of the turbine rotating blade.

Figure 4:
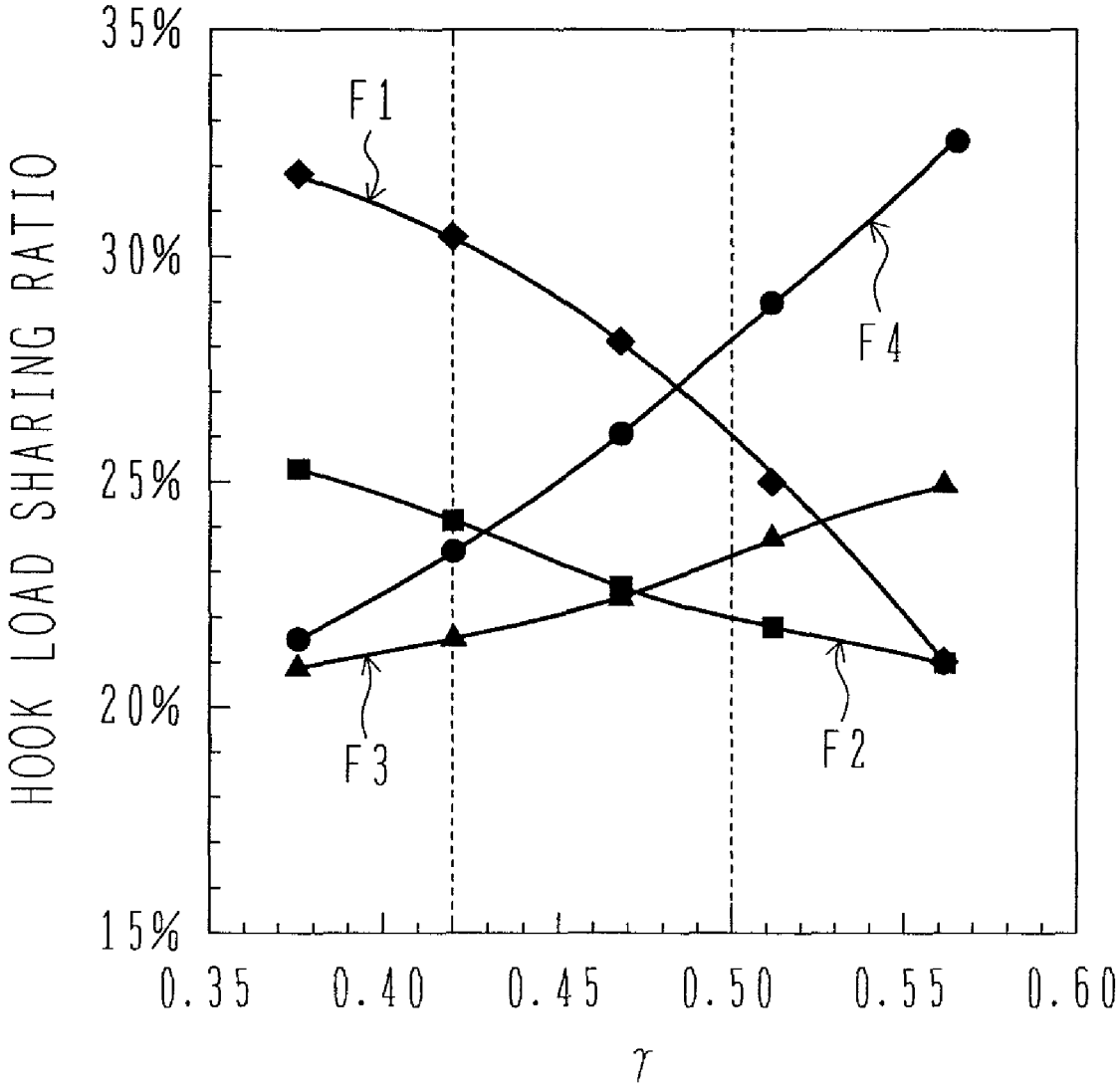
FIG. 4 is a diagram explaining a relationship between a groove magnification and a hook load distribution ratio.

FIG. 4 shows a relationship between the blade groove enlarging parameter "•" and a hook load distribution ratio based on FEM analyses.

As the blade groove is enlarged ("•" is increased), there is a tendency of the innermost circumferential rotor hook to increase in hook load distribution ratio (see F4 in FIG. 4), and rotor intermediate hooks to decrease in hook load distribution ratio (see F2 and F3 in FIG. 4).

The region of "•" (0.42≦•≦0.50) is equivalent to a region in which, as shown in FIG. 4, the hook load distribution ratio of the innermost circumferential rotor hook increases, compared with the hook load distribution ratios of the rotor intermediate hooks.

Therefore, the hook contact surface of the innermost circumferential rotor hook is formed so that the associated distance $Lr_n$ satisfies the relationship of $Lr_n > Lr_i$ (i=2 to n−1) with respect to the hook contact surface distance $Lr_i$ of the ith hook, that is, the 2nd−(n−1)th hook, from the outermost circumferential rotor hook, and the radial hook length $Rr_n$ and hook contact surface distance $Lr_n$ of the innermost circumferential rotor hook larger in load distribution ratio are increased. These measures are considered to make appropriate distribution of stresses between hooks possible, since the shear stress and the contact surface pressure are reduced.

F1 is a hook load distribution ratio curve of the outermost circumferential rotor hook, F2 and F3 are hook load distribution ratio curves of the rotor intermediate hooks, and F4 is a hook load distribution ratio curve of the innermost circumferential rotor hook.

Next, further detailed comparison results on the structures of the present embodiment and on the stresses occurring in the conventional structure are described below.

A hook contact surface distance ratio between the hook contact surface distance $Lr_n$ of the innermost circumferential rotor hook and the hook contact surface distance $Lr_{n-1}$ of the (n−1)th hook from the outermost circumferential rotor hook is defined as a parameter • (=$Lr_n/Lr_{n-1}$).

Figure 5A:
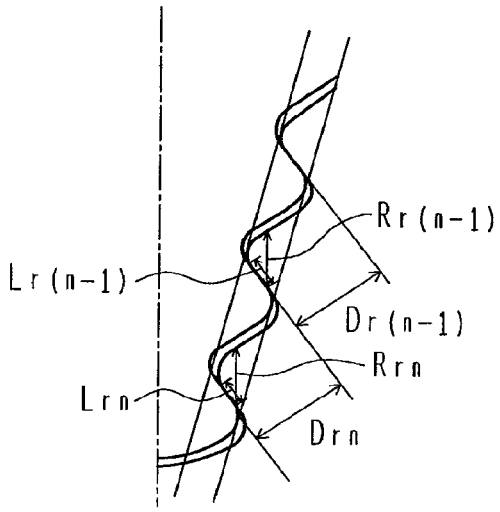
FIG. 5A PRIOR ART
FIGS. 5A to 5D are comparative diagrams of a dimensional relationship between rotor hooks and blade hooks of the embodiment.

Shapes that have been studied assume the following four cases:

FIG. 5A shows the conventional structure, wherein hook contact surface distance ratio • (=$Lr_n/Lr_{n-1}$) is equal to 0.7, hook contact surface normal-line distance $Dr_n$ is equal to $Dr_{n-1}$, and radial hook length $Rr_n$ is equal to $Rr_{n-1}$.

$Rr_{n-1}$ is the radial hook length from the outermost circumferential rotor hook to the (n−1)th hook.

Figure 5B:
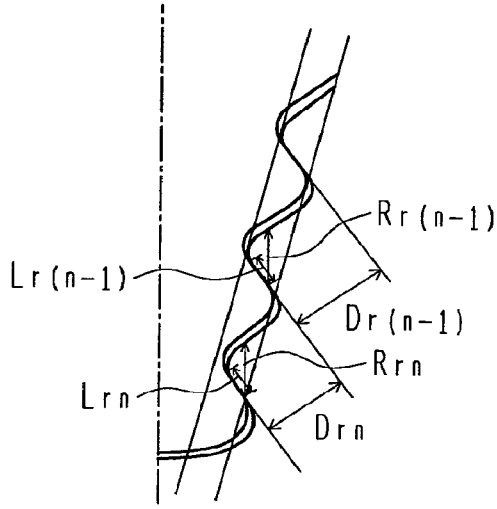

FIG. 5B shows the structure of the present embodiment with increased circumferential width $Wr_n$ of the innermost circumferential rotor hook. In this structure, hook contact surface distance ratio • (=$Lr_n/Lr_{n-1}$) is 1.0, hook contact surface normal-line distance $Dr_n$ is less than $Dr_{n-1}$, and radial hook length $Rr_n$ is equal to $Rr_{n-1}$.

Figure 5C:
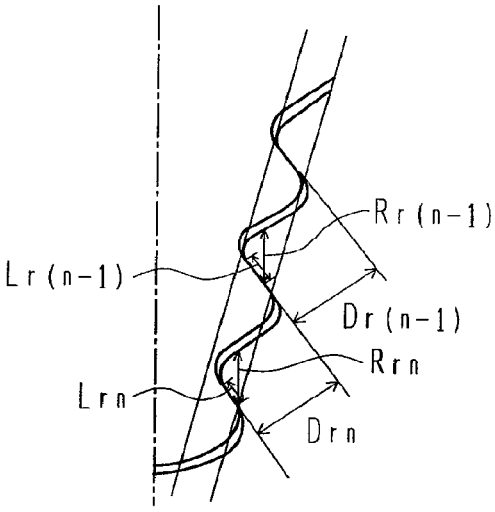

FIG. 5C shows the structure of FIG. 2B with increased circumferential width $Wr_n$ of the innermost circumferential rotor hook. In this structure, hook contact surface distance ratio • (=$Lr_n/Lr_{n-1}$) is 0.65, hook contact surface normal-line distance $Dr_n$ is equal to $Dr_{n-1}$, and radial hook length $Rr_n$ is equal to $Rr_{n-1}$.

Figure 5D:
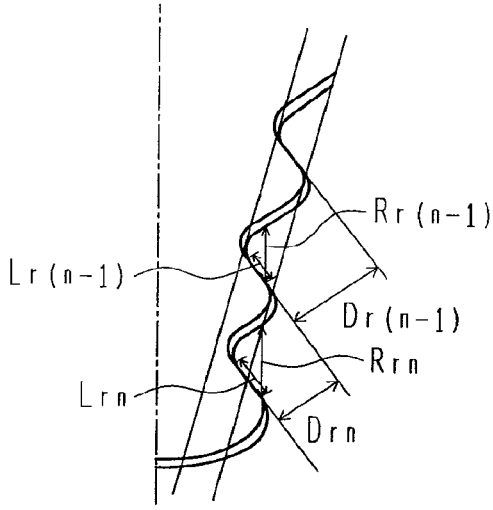

FIG. 5D shows the structure of the present embodiment, further improved in stress balance, and in this structure, hook contact surface distance ratio • (=$Lr_n/Lr_{n-1}$) is 1.3, hook contact surface normal-line distance $Dr_n$ is less than $Dr_{n-1}$, and radial hook length $Rr_n$ is greater than $Rr_{n-1}$.

Figure 6:
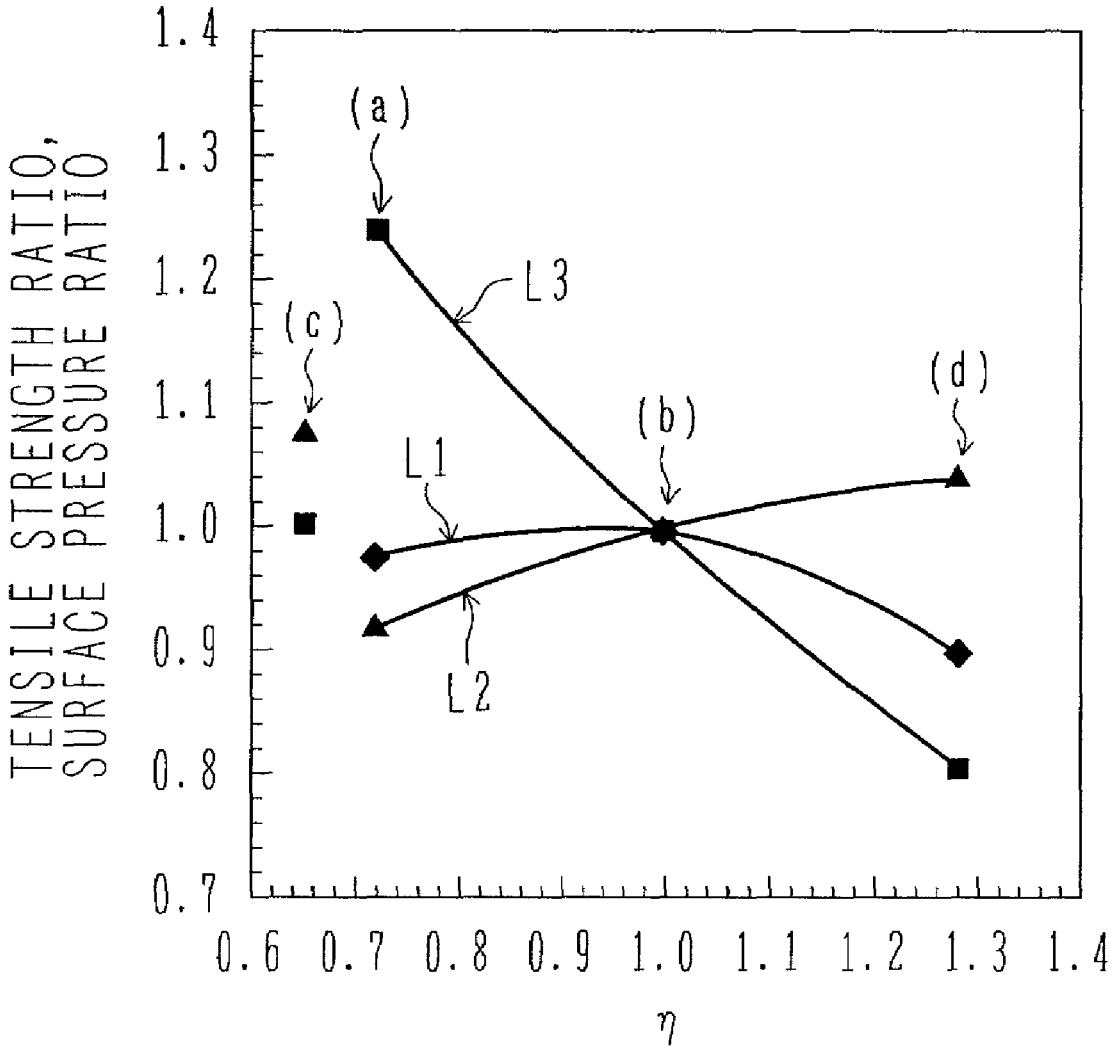
FIG. 6 is a diagram that explains advantageous effects of the embodiment.

FIG. 6 shows comparison results on the shear strength ratios, tensile strength ratios, and contact surface pressure ratios obtained in the structures of FIGS. 5A, 5B, 5C, 5D when •=0.43. The comparison results are shown with the structure of FIG. 5B as their basis.

In FIG. 6, L1 is a shear strength ratio curve of the turbine rotor; L2, a tensile strength ratio curve thereof; and L3, a contact surface pressure ratio curve thereof.

In the structure of FIG. 5A, a space is formed between the innermost opposed surfaces lying across the blade neck and rotor hook region by increasing only the circumferential width $Wr_n$ of the innermost circumferential rotor hook, so surface pressures are not equalized since the hook contact surface distance $Lr_n$ of the innermost circumferential rotor hook between the blade and the rotor is short and the contact surface pressure ratio (see L3 in FIG. 6) is impermissibly large.

In the structure of the present embodiment that is shown in FIG. 5B, however, it is possible to ensure a sufficient hook contact surface distance $Lr_n$ of the innermost circumferential rotor hook between the blade and the rotor, and thus the contact surface pressure ratio (see L3, FIG. 6) is reduced.

In the structure of FIG. 5C with increased radial depth of the rotor groove in FIG. 2B, circumferential hook width $Wr_n$ of the rotor innermost circumferential neck decreases and a tensile stress increases. In this structure, therefore, the circumferential hook width $Wr_n$ of the rotor innermost circumferential neck needs to be increased so that the hook contact surface normal-line distance satisfies the relationship of $Dr_n < Dr_i$.

Finally, in the structure of the present embodiment that is shown in FIG. 5D with further improvements in stress balance, the shear strength ratio (see L1 in FIG. 6) and the contact surface pressure ratio (see L3 in FIG. 6) are expected to be further reducible by approximately 10% and approximately 20%, respectively, from those achievable in the structure of FIG. 5B.

However, • desirably satisfies 1.0≦•≦1.3 since, if • is increased too much, the circumferential hook width $Wr_n$ of the rotor innermost circumferential neck decreases and the tensile strength ratio (L2 in FIG. 6) becomes excessive.

It can be seen from these facts that a turbine rotor in which the rotor groove has improved machinability and in which a stress balance is made appropriate is achieved by adopting the structure shown in FIG. 5B or 5D.

In addition, in the present embodiment, the stresses occurring on hook shear surfaces can be further reduced by making the insertion angle of the blade oblique to the axial direction of the rotor, since the oblique insertion of the blade makes an axial distance increasable by an inverse multiple of a cosine of the oblique angle •.

Although the advantageous effects obtainable when the number of hooks, "n", is 4, are described in the present embodiment, it is already confirmed that essentially the same effects are also obtainable when the number of hooks, "n", is other than 4.

In addition, although enlarging the blade groove to reduce the stresses thereon has posed the problems of the rotor groove increasing in radial depth and the innermost circumferential rotor hook becoming difficult to cut, these problems can be solved by adopting the structure according to the present embodiment.

Furthermore, if the rotor is damaged by overcutting, the damage has significant effects, compared with blade damage. Although particularly high machining accuracy has traditionally been required for rotor machining, these problems can also be solved by the present embodiment.

Besides, while the blade groove has a large number of evaluation items to be attentive to in connection with strength design, such as shear stress, tensile stress, peak stress, and contact surface pressure, these evaluation items can be addressed according to the present embodiment.

Hence, the important problem of how to simultaneously achieve the improvement of the innermost circumferential rotor hook in machinability and the appropriate balancing between the stresses and surface pressures, can be solved by adopting the structure of the present embodiment.

Second Embodiment

Figure 7:
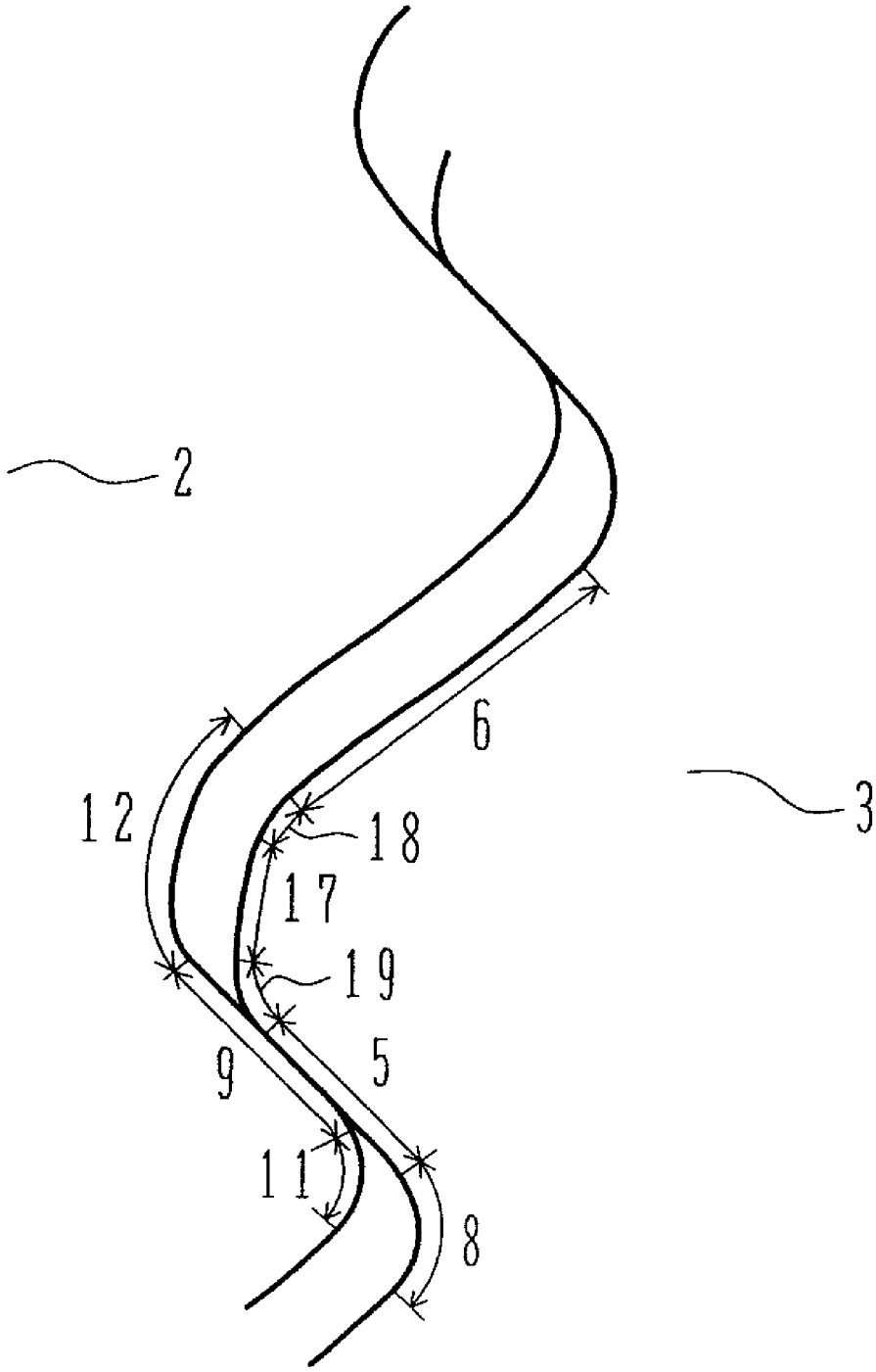
FIG. 7 is a diagram showing another embodiment.

A second embodiment of the present invention is shown in FIG. 7.

In terms of rotor hook shape, a turbine rotor 3 may be constructed so that a rotor hook contact surface 5 and a rotor hook non-contact surface 6 are interconnected by a rotor hook flat surface 17 and inscribed circle surfaces 18 and 19 formed at both ends of the flat surface 17.

The inscribed circle surface 18 forms a hook portion arc at the non-contact surface side of the turbine rotor, and the inscribed circle surface 19 forms a hook portion arc at the contact surface side of the turbine rotor.

In addition, arcs each forming a hook portion or neck portion at the ith hook or neck from the outermost circumferential position, between a blade and the rotor, do not need to be identical arcs and associated regions may each be formed by a combination of two different arcs or of a flat surface and two different arcs formed at both ends of the flat surface. Furthermore, the outermost circumferential rotor hook, intermediate rotor hooks, and the innermost circumferential rotor hook may each be formed by the above combination.

The present invention can be applied to steam turbines.

What is claimed is:

1. A turbine rotor with a rotor hook and a rotor neck constructed to form an attachment structure with respect to an inverted fir tree blade root having blade hooks and blade necks with an "n" number of the hooks ($n \geqq 3$), wherein:

a convex portion of the innermost circumferential rotor hook is formed to offset in a circumferential direction, with respect to a tangential line that connects a convex portion of the (n−1)th hook from the outermost circumferential rotor hook and a convex portion of the (n−2)th hook, to form a gap between the convex portion and the tangential line.

2. The turbine rotor according to claim 1, wherein:

the relationship of $Wr_n > Wr_{n-1} - 2Hr_n \times \tan \beta r$ is satisfied, where $\beta r$ is an angle formed between a tangential line connecting the convex portion of the (n−1)th hook from the outermost circumferential rotor hook and the convex portion of the (n−2)th hook, and a radial centerline, $Hr_n$ is a radial distance between a convex portion of the nth hook from the outermost circumferential rotor hook and the convex portion of the (n−1)th hook, $Wr_n$ is a circumferential width of the innermost circumferential rotor hook, and $Wr_{n-1}$ is a circumferential width of the (n−1)th hook from the outermost circumferential rotor hook.

3. The turbine rotor according to claim 1, wherein:

the relationship of $Dr_n < Dr_i$ is satisfied, where $Dr_n$ is a distance between a normal to a hook contact surface of the nth hook from the outermost circumferential rotor hook and a normal to a hook contact surface of the (n−1)th hook, and $Dr_i$ is a distance between a normal to a hook contact surface of the ith hook (i=2 to (n−1)) from the outermost circumferential rotor hook and a normal to a hook contact surface of the (i−1)th hook.

4. The turbine rotor according to claim 1, wherein:

a concave portion of the rotor innermost circumferential neck is formed to be concave in a circumferential direction, with respect to a tangential line that connects a concave portion of the (n−1)th neck from the rotor outermost circumferential neck and a concave portion of the (n−2)th neck.

5. The turbine rotor according to claim 1, wherein:

the relationship of $Lr_n > Lr_i$ is satisfied, where $Lr_n$ is a hook contact surface distance at which a rotating blade and the rotor come into contact at the innermost circumferential rotor hook, and $Lr_i$ is a hook contact surface distance at which the rotating blade and the rotor come into contact at the ith hook (i=2 to (n−1)) from the outermost circumferential rotor hook.

6. The turbine rotor according to claim 1, wherein:

a contact surface on which the blade and the rotor come into contact at a hook of the rotor, and a non-contact surface formed at an outer circumferential position with respect to the contact surface are constructed to be interconnected by a flat surface and inscribed circle surfaces formed at both ends of the flat surface.

7. The turbine rotor according to claim 1, wherein:

an insertion angle for attaching to the blade is oblique with respect to an axial direction of the rotor.

8. An inverted fir tree type turbine rotating blade with blade hooks and blade necks with an "n" number of the hooks ($n \geqq 3$), the hooks being constructed to form an attachment structure with respect to a turbine rotor which has rotor hooks and rotor necks, wherein:

a concave portion of the blade innermost circumferential neck is formed to offset in a circumferential direction, with respect to a tangential line that connects a concave portion of the (n−1)th neck from the blade outermost circumferential neck and a concave portion of the (n−2)th neck, to form a gap between the convex portion and the tangential line.

9. The turbine rotating blade according to claim 8, wherein:

the relationship of $Wb_n > Wb_{n-1} - 2Hb_n \times \tan \beta b$ is satisfied, where $\beta b$ is an angle formed between a tangential line connecting the concave portion of the (n−1)th neck from the blade outermost circumferential neck and the concave portion of the (n−2)th neck, and a radial centerline, $Hb_n$ is a radial distance between a concave portion of the nth neck from the blade outermost circumferential neck and the concave portion of the (n−1)th neck, $Wb_n$ is a circumferential width of the blade innermost circumferential neck, and $Wb_{n-1}$ is a circumferential width of the (n−1)th neck from the blade outermost circumferential neck.

10. The turbine rotating blade according to claim 8, wherein:

the relationship of $Db_n<Db_i$ is satisfied, where $Db_n$ is a distance between a normal to a hook contact surface of the nth hook from the outermost circumferential blade hook and a normal to a hook contact surface of the (n−1)th hook, and $Db_i$ is a distance between a normal to a hook contact surface of the ith hook (i=2 to (n−1)) from the outermost circumferential blade hook and a normal to a hook contact surface of the (i−1)th hook.

11. The turbine rotating blade according to claim 8, wherein:

a convex portion of the innermost circumferential blade hook is formed to be convex in a circumferential direction; with respect to a tangential line that connects a convex portion of the (n−1)th hook from the outermost circumferential blade hook and a convex portion of the (n−2)th hook.

12. The turbine rotating blade according to claim 8, wherein:

the relationship of $Lb_n>Lb_i$ is satisfied, where $Lb_n$ is a hook contact surface distance at which the rotating blade and the rotor come into contact at the innermost circumferential blade hook, and $Lb_i$ is a hook contact surface, distance at which the rotating blade and the rotor come into contact at the ith hook (i=2 to (n−1)) from the outermost circumferential blade hook.

13. The turbine rotating blade according to claim 8, wherein:

a contact surface on which the blade and the rotor come into contact at a hook of the blade, and a non-contact surface formed at an inner circumferential position with respect to the contact surface are constructed to be interconnected by a flat surface and inscribed circle surfaces formed at both ends of the flat surface.

14. The turbine rotating blade according to claim 8, wherein:

an angle of insertion of the blade root into the rotor is oblique with respect to an axial direction of the rotor.

* * * * *